United States Patent [19]

Akkerman et al.

[11] 4,263,839

[45] Apr. 28, 1981

[54] HEAT SENSITIVE LOCKING DEVICE

[75] Inventors: Neil H. Akkerman, Kingwood, Tex.; Kip B. Goans, Harvey, La.

[73] Assignee: Baker CAC, Inc., Belle Chasse, La.

[21] Appl. No.: 80,731

[22] Filed: Oct. 1, 1979

[51] Int. Cl.[3] ..... F15B 15/26

[52] U.S. Cl. ..... 92/23; 137/75; 169/42; 236/DIG. 5

[58] Field of Search ..... 92/15, 23, 26; 60/635, 60/636; 169/42, 57; 236/DIG. 5; 137/72, 75

[56] References Cited

U.S. PATENT DOCUMENTS

| | | | |
|---|---|---|---|
| 1,248,861 | 12/1917 | Holloway | 92/23 |
| 1,332,283 | 3/1920 | Bancroft | 137/75 |
| 3,169,008 | 2/1965 | Whitlock | 236/DIG. 5 |
| 3,180,524 | 4/1965 | Shepard | 169/42 |
| 3,424,403 | 1/1969 | Hull | 92/26 |
| 3,659,624 | 5/1972 | Kelly | 137/75 |
| 3,826,313 | 7/1974 | Yao | 169/42 |

FOREIGN PATENT DOCUMENTS

| | | | |
|---|---|---|---|
| 538688 | 3/1957 | Canada | 92/26 |

*Primary Examiner*—Abraham Hershkovitz
*Attorney, Agent, or Firm*—William C. Norvell, Jr.

[57] ABSTRACT

A heat sensitive locking device is preferably provided for a fluid actuator of the type which is moved in a direction to one position through the application of fluid pressure and remains in such position unless temperature conditions surrounding the device reach a level indicating that the actuator should be shifted to another position. The locking device comprises a core attachable to an exposed end of, for example, the piston shaft, and an annular collar surrounding such core and attached to the cylinder. A plurality of annular segmental shaped locking members are disposed between the core and collar and pivotally mounted so as to be movable to a locking position or to an unlocked position, each relative to the core. The annular locking elements are held in their locking position by being wrapped by a resilient spring wire, the ends of which are anchored to the locking members by means including a minimal size fusible link.

6 Claims, 4 Drawing Figures

HEAT SENSITIVE LOCKING DEVICE

BACKGROUND OF THE INVENTION

1. Field of the Invention

This invention relates to a locking device having particular utility for use with an actuator. The device can be released from its locked position by the occurrence of an elevated temperature immediate the device.

2. Description of the Prior Art

Temperature released, locking mechanisms have heretofore been provided for actuators for valves. Such actuators have generally incorporated a mass of fusible material to hold the locking elements of the device in a locked position until the occurrence of an undesirably high temperature immediate the device. Because a relatively large mass of fusible material is employed in such devices, the actuator has to be exposed to the elevated temperature for a substantial time period in order for the mass of the fusible material to be sufficiently heated to cause the entire mass to melt and permit the locking device to move to an unlocked position. Moreover, such devices cannot be readily reconstructed in the field after they have once functioned in response to an elevated temperature because of the difficulty of melting and applying a relatively large mass of fusible material.

There is, therefore, a need for a fast response temperature released, locking device having particular utility when used with an actuator or other linearly operated device wherein the fusible element which holds the locking device in a locked position is of very limited size and simple configuration such that the fusible element may be readily replaced whenever it is necessary to reactivate the heat sensitive locking device after melting of the original fusible element and releasing of the latching mechanism.

SUMMARY OF THE INVENTION

The invention comtemplates the utilization of a locking mechanism comprising an assembly including a locking core element which is attachable to, for example, the piston shaft of an actuator, a surrounding collar element which is attachable to the cylinder portion of the actuator and a plurality of annular segment locking members which are pivotally mounted in the space between the locking core and the surrounding collar for movement between a locking position, wherein locking shoulders on the annular segments engage a radial locking surface on the core, and unlocked position wherein the locking segments are moved out of engagement with the locking surfaces on the core to permit the core, and hence the actuator shaft, to move relative to the actuator cylinder. The annular segment locking members are retained in their locked position by being wrapped by a coiled length of spring wire, the ends of which are anchored to the annular segments by means including a small fusible link. Accordingly, the locking members will remain in their locked position and hence rigidly secure the actuator piston shaft in a fixed position relative to the actuator cylinder until the occurrence of an elevated temperature in the vicinity of the device sufficient to effect the melting of the small fusible link. In the event of such melting, the link severs, the coiled wire spring unwinds and the segments are free to move under the forces generated on them by the piston shaft to their unlocking position, thereby freeing the piston shaft for movement relative to the actuator cylinder.

Because the temperature responsive locking mechanism of this invention employs a very small fusible component, it is capable of very fast response to the occurrence of an undesirably high temperature immediate the locking device. The speed of the response far exceeds that of any of the prior art heat responsive locking devices.

The locking mechanism may be readily restored to its original condition merely by rewinding the coiled spring around the locking elements to pull them into their locking position relative to the core member and inserting a new fusible link in the anchoring means provided for securing the ends of the wire spring to the core member.

DESCRIPTION OF THE PREFERRED EMBODIMENTS

Figure 1:
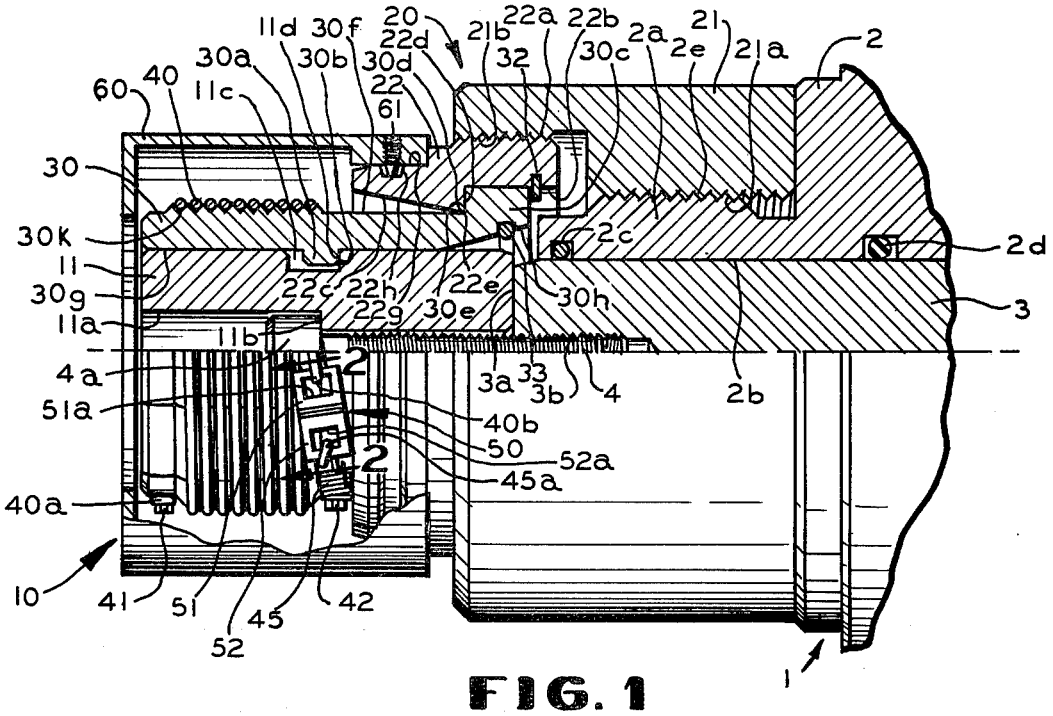
FIG. 1 is an elevational view, with the top half portion shown in vertical section and other portions broken away, of a heat sensitive lock for an actuator embodying this invention, shown with the locking elements disposed in their locked position.
Figure 3:
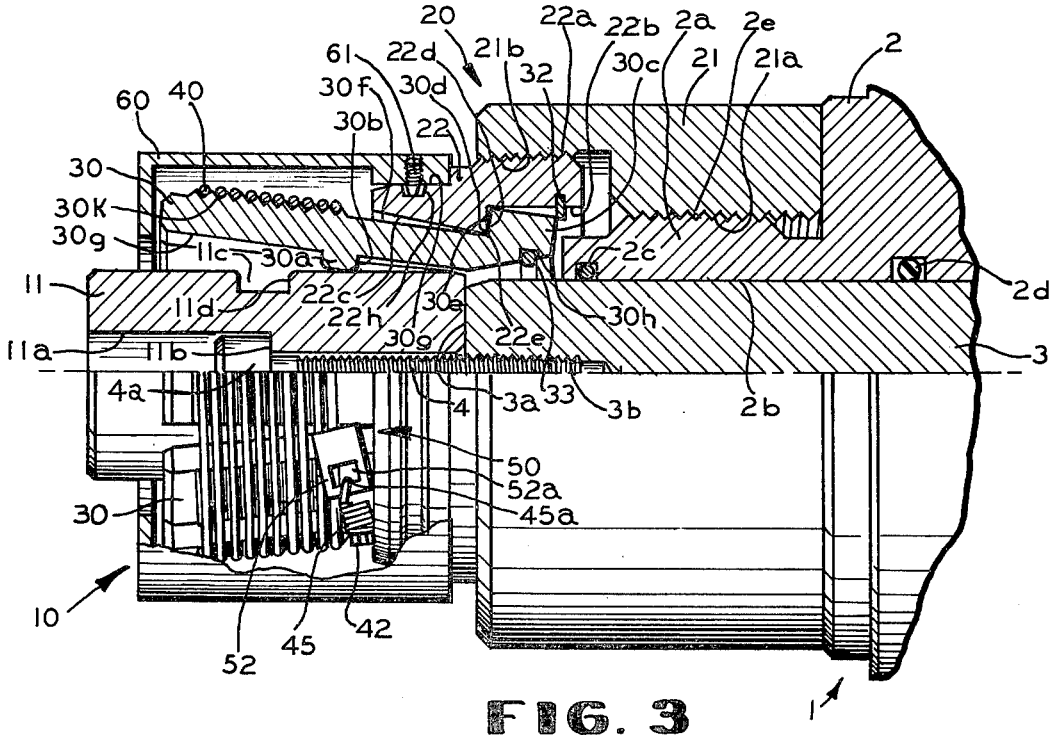
FIG. 3 is a view similar to FIG. 1 but showing the position of the locking elements after separation of fusible link.
Figure 4:
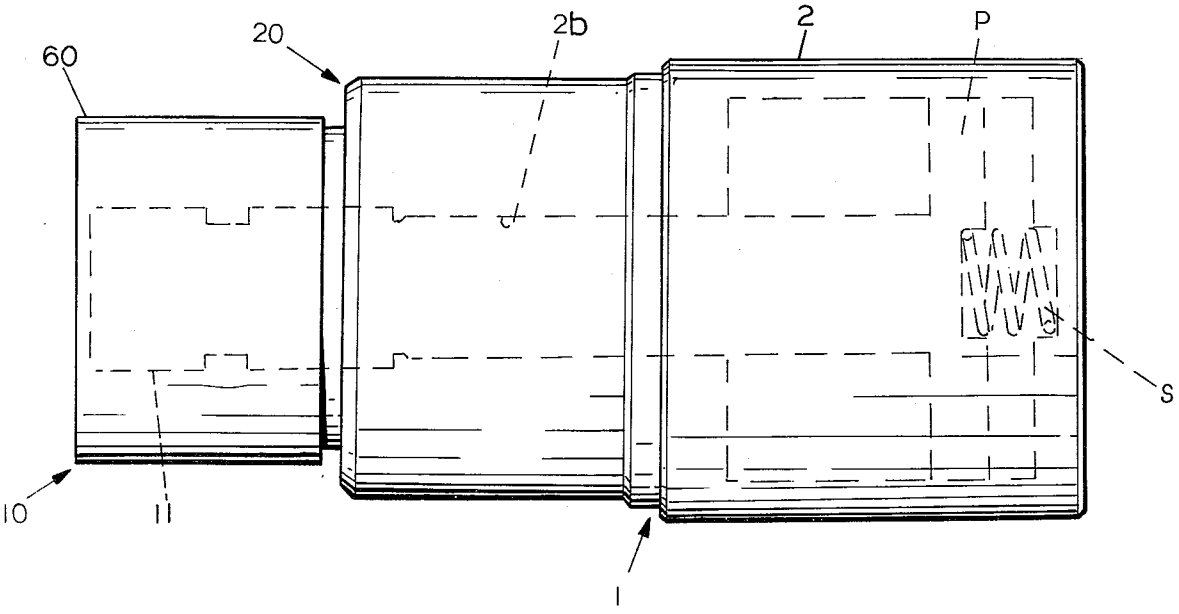
FIG. 4 is a schematic elevational view of the complete actuator in its locked position.

Referring to FIGS. 1 and 3, the numeral 1 indicates generally one end of a conventional actuator including a cylinder 2, a piston P reciprocatingly mounted within the cylinder 2 and a piston shaft 3 which, in either extreme axial position of the piston relative to the cylinder has its end surface 3*a* exposed or accessible adjacent a reduced diameter end 2*a* of the cylinder 2. Conventional bearing rings 2*c* and O-ring seals 2*d* are provided between an internal wall 2*b* of cylinder portion 2 and the shaft 3. The reduced diameter end 2*a* of the cylinder is provided with external threads 2*e* which may be employed for mounting a coupling component 21 of a locking mechanism 10 to the cylinder. The exposed shaft end 3*a* is provided with an internally threaded bore 3*b* to receive a bolt 4 for mounting a core member 11 of the locking device 10 to the actuator.

The locking device 10 comprises a generally cylindrical locking core member 11 having an axial bore 11*a* extending therethrough and defining an internal shoulder 11*b* for engagement by a head 4*a* of the bolt 4. The locking core 11 is thus rigidly secured in generally coaxial relationship to the end 3*a* of the piston shaft 3. Near the axial center of locking core member 11, an annular groove 11*c* is provided defining a radial plane locking shoulder 11*d*.

A second major component of the locking mechanism 10 is a collar assembly 20. This assembly includes the annular coupling member 21 having internal threads 21*a* in one end engageable with the threads 2*e* on the adjacent end 2*a* of the cylinder 2, and larger diameter internal threads 21*b* in the other end engageable with external threads 22*a* provided on the periphery of a pivot defining member 22 of the collar assembly 20. Pivot defining element 22 is of annular configuration and has an internal cylindrical surface 22b radially spaced from the external surface of the locking core 11 and an internal conical surface 22c connected to internal surface 22b by a radial shoulder section 22d to define a circular pivot edge 22e.

A plurality of generally "L" shaped annular segment locking elements 30 are disposed within the annulus defined between the pivot defining collar element 22 and the locking core 11. Each such annular segment 30 has an internally projecting lug portion 30a defining a locking shoulder 30b which, in the locked position of the segment 30 engages the locking shoulder 11d provided on collar 11. The right hand end portion of each locking segment is radially enlarged as at 30c to snugly conform to the internal configuration of the pivot defining element 22. The pivot edge 22e then engages a rectangular corner 30d defined between a radial plane surface 30e on the annular segments and an axially extending cylindrical segment surface 30f. The inner walls 30g of each annular locking segment 30 snugly conform to the adjacent cylindrical wall of the locking core 11 except for the extreme right hand end portion 30h which is outwardly inclined so as to permit each annular locking segment to freely pivot outwardly about the circular pivot edge 22e to assume the unlocked position, shown in FIG. 3, wherein the locking lugs 30a of the locking segments 30 are completely removed from engagement with the locking surface 11d on the locking core 11.

The locking segments 30, when disposed in their locked position shown in FIG. 1 define a complete annular member. Such member is retained against axial movement by a split ring retainer 32 mounted in an appropriate slot in the right hand end of the pivot defining element 22. The individual elements are further retained by a split ring spring 33 in an appropriate annular groove in the outer end of the inclined surfaces 30h of the locking segments 30.

The annular locking segments 30 are held in their peripherally abutting, locked positions by snugly wrapping a wire spring 40 around the periphery of such annular elements. The wrapping of the wire spring 40 may be facilitated by providing a continuous thread 30k on the external surface of the annular locking segments 30 within which the successive turns of the wire spring 40 may be embedded. Anchoring means are provided for each end of the wire spring 40, such as an anchor bolt 41 which is radially threaded into the left hand end of one of the annular locking segments 30 and is engaged by a coiled end portion 40a of the wire spring 40. A second anchor bolt 42 is provided on the right hand end of the same annular segment 30 and is connected to the coiled end 40b of the wire spring 40 through a fusible link 50 and a tension spring 45. The tension spring 45 assures that a uniform amount of tension is always applied to the wire spring 40.

Figure 2:
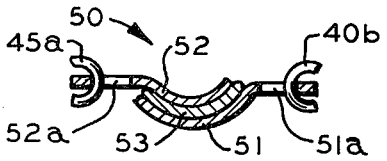
FIG. 2 is a sectional view of the fusible link employed in the locking device of FIG. 1, taken on the plane 2—2 of FIG. 1.

Referring particularly to FIG. 2, a fusible link 50 will be seen to comprise a pair of thin plates 51 and 52 having a generally arcuate configuration and being bonded together by a heat fusible eutectic material 53. The unbonded end of each of the plates 51 and 52 is provided with a suitable aperture 51a and 52a to respectively receive the coiled end 40b of wire spring 40 and the end loop 45a of the tension spring 45. The link 50 is of minimal dimensions necessary to hold the wire spring 40 in the wrapped position.

In order to eliminate any possibility of tampering or inadvertent damage to the wire spring 40 and the fusible link 50, a cover cap 60 is commonly provided to surround the outer end of the annular locking segments 30, yet providing sufficient space for such segments 30 to move outwardly to their unlocked position. The cap 60 may be retained on a reduced diameter portion 22g of the pivot defining collar 22 and retained thereon by a set screw 61 engaging an annular groove 22h provided in such collar element.

In the utilization of the described heat sensitive locking mechanism with an actuator which is linearly operational, the locking structure 10 is pre-assembled in the position shown in FIG. 1, and applied to the actuator 1 by first threadably engaging the collar 21 with the threads 2e of the cylinder 2 until the collar 21 bottoms against the cylinder 2, then the pivot defining collar 22 is adjusted by means of threads 22a until the locking core 11 contacts the actuator shaft 3, and then securing the locking core 11 to the shaft 3 by inserting the bolt 4. The locking of actuator 1 is generally desired to be accomplished at that position where the internal spring provided in the actuator for returning the piston to one of its extreme axial positions is fully compressed. In the drawings, the piston shaft 3 is assumed to be spring biased to the left, but held in its illustrated position by fluid pressure. Thus, after the locking mechanism has been applied to the actuator 1, the release of fluid pressure within the cylinder 2 will subject the piston and its connected shaft 3 to the full force of the return spring S which would tend to move the piston 2 to the left as viewed in the drawings. Such force on the piston is resisted by the interengagement of the locking lugs 30a of segments 30 with the locking shoulder 11d provided on locking core 11 and, hence, no movement of the piston shaft 3 relative to the cylinder 2 can occur. However, an outward pivoting force about pivot edge 22e is imposed on the segments 30 by the relative proximity of pivot edge 22e with respect to locking shoulder 11d under the influence of the bias force of the actuator shaft 3.

Whenever the temperature in the vicinity of the locking mechanism reaches an undesirably high value, it will be immediately sensed by the fusible link 50 and, because such link is of relatively small dimensions and incorporates only a small quantity of eutectic material, the response of the fusible link to the undesirably high temperature condition will be very rapid, resulting in the separation of the link components 51 and 52. This permits the wire spring 40 to uncoil and the locking segments 30 are immediately pivoted due to the fact that the entire force of the actuator spring or biasing mechanism is exerted on locking surfaces 30a on locking segments 30 at a position radially displaced from the circular pivot edge 22e. It follows that a substantially instantaneous release of the locking mechanism is obtained and the shaft 3 rapidly moves to the position shown in FIG. 3.

The described heat sensitive locking mechanism 10 may be restored to its original condition merely by removal of the cap 60, rewinding of the wire spring 40 around the locking segments 30 and incorporation of a new fusible link 50 in the anchoring means for the wire spring 40. Thus many successive uses of the heat sensitive locking mechanism may be obtained without in any manner affecting the reliability of either the locking function or the heat sensitive release of the locking mechanism.

Although the invention has been described in terms of specified embodiments which has been set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a fluid actuator having a cylinder and a piston mounted therein, said piston having a shaft end portion exposed when the piston is positioned in one of its extreme axial positions relative to the cylinder, the improvement comprising: locking means secured to the exposed shaft end of the piston defining an exposed peripherally extending radial plane locking surface; an annular collar surrounding said exposed locking surface and radially spaced therefrom; means for securing said collar to the adjacent end of the cylinder; a plurality of locking segments disposed between said collar and said locking means; means for mounting each said locking segment for pivotal movement relative to said shaft between two positions, respectively, a locking position wherein a portion of each said locking segment abuts said locking means and an unlocking position wherein each said locking segment is spaced relative to said locking means, each said locking segment having a locking shoulder engagable with a portion of said peripheral locking surface on said locking means in its said locking position to prevent movement of the piston away from said one extreme axial position; a spring wire resiliently wrapped around said locking segments to retain same in said locking position; and means including a fusible link for anchoring both ends of said spring wire to said locking segments, whereby the melting of said fusible link permits the spring wire to uncoil and release said locking segments for movement to their unlocked positions.

2. The heat sensitive lock of claim 1 wherein said anchoring means includes a tension spring.

3. A heat sensitive, fluid actuator comprising: a cylinder; a piston reciprocatingly mounted therein for movement between two extreme axial positions; resilient means urging said piston to one of its extreme axial positions; a shaft portion of said piston having its end exposed whenever said piston is in the extreme axial position opposite that to which it is urged by said resilient means; a locking core attachable to said exposed end of the piston in co-axial alignment therewith, said locking core defining a peripherally extending radial plane locking surface; an annular collar surrounding said locking core and radially spaced therefrom; means for securing said collar to the adjacent end of said cylinder; a plurality of locking segments disposed between said collar and said locking core; cooperating means on said collar and each said locking segment for mounting each said locking segment for pivotal movement relative to said collar between two positions, respectively, a locking position wherein each said locking segment abuts said locking core and an unlocking position wherein each said locking segment is spaced relative to said core, each said locking segment having a locking shoulder engageable with a portion of said peripheral locking surface on said locking core in said locking position; a spring wire resiliently wrapped around said locking segments to retain same in said locking positions against the bias of said actuator resilient means, whereby said actuator piston is retained in its fluid actuated extreme axial position against the bias of said resilient means; and means including a fusible link for anchoring one end of said spring wire to one of said locking segments, whereby the melting of said fusible link permits the spring wire to uncoil and release said locking segments for movement to their unlocked positions.

4. The apparatus of claim 3 wherein said anchoring means includes a tension spring.

5. The apparatus of claim 1 or 3 wherein said locking segments comprise annular segments disposed in peripheral abutment in the locking positions of said segments.

6. The apparatus of claim 1 or 3 wherein said mounting means comprises an internal circular edge on said collar cooperating with an internal corner formed on each of said locking segments.

* * * * *